US008820247B1

(12) United States Patent
Claussen et al.

(10) Patent No.: US 8,820,247 B1
(45) Date of Patent: Sep. 2, 2014

(54) METHOD AND APPARATUS FOR LOCOMOTIVE RETROFIT

(75) Inventors: Pete Claussen, Knoxville, TN (US); Scott Gatewood, Knoxville, TN (US); Robert Anthony Di Domizio, Jr., Hatfield, PA (US); David Tennent, Kenneth Square, PA (US); Tom German, Fredericksburg, VA (US)

(73) Assignee: Knoxville Locomotive Works, Inc., Knoxville, TN (US)

( * ) Notice: Subject to any disclaimer, the term of this patent is extended or adjusted under 35 U.S.C. 154(b) by 562 days.

(21) Appl. No.: 12/916,708

(22) Filed: Nov. 1, 2010

Related U.S. Application Data

(60) Provisional application No. 61/289,221, filed on Dec. 22, 2009.

(51) Int. Cl.
*B61C 3/00* (2006.01)

(52) U.S. Cl.
USPC ..... 105/35

(58) Field of Classification Search
USPC ..... 105/26.05, 27–39, 49, 50, 61.5, 62.1
See application file for complete search history.

(56) References Cited

U.S. PATENT DOCUMENTS 6,267,062 B1 * 7/2001 Hamilton, Jr. ..... 105/26.05
6,279,309 B1 * 8/2001 Lawlor et al. ..... 60/772
8,167,062 B2 5/2012 Wolff et al.

OTHER PUBLICATIONS

Cotta Transmission Company, Rockford, Illinois, "Locomotive Repower", Application Sheet (6 pages), Jun. 1984.

* cited by examiner

*Primary Examiner* — R.J. McCarry, Jr.
(74) *Attorney, Agent, or Firm* — Leudeka Neely Group, PC

(57) ABSTRACT

A method and apparatus for enabling rebuilding of locomotives by replacing the existing two-stroke diesel engine with a four-stroke diesel engine, while retaining the generator and its associated electronics.

9 Claims, 4 Drawing Sheets

METHOD AND APPARATUS FOR LOCOMOTIVE RETROFIT

CROSS-REFERENCE TO RELATED APPLICATION

This application claims priority to U.S. Provisional Application No. 61/289,221 filed Dec. 22, 2009, and entitled "Method and Apparatus for Locomotive Retrofit," incorporated by reference herein in its entirety

FIELD

The present disclosure relates to the field of locomotive engine retrofitting or rebuilding. More particularly, the disclosure relates to the rebuilding of locomotives by replacing the existing two-stroke diesel engine with a four-stroke diesel engine, while retaining the generator and its associated electronics.

BACKGROUND

Locomotives have a large prime mover, usually a 12 or 16 cylinder diesel motor that typically drives, on one end, a DC and/or AC main generator and/or an auxiliary generator; and also at least one air compressor. The main generator produces electricity that is transmitted to electric traction motors that sit on top of each axle and provide power to the wheels. The auxiliary generator provides the power for appliances on the locomotive, such as headlights, fans, and the like. The compressor provides air pressure for operating the air brakes. The cab of the locomotive includes various components, including an electrical cabinet; main and auxiliary generators, diesel motor/engine, and an air compressor.

About 99% of the locomotives in service today are made by two manufacturers: Electro-Motive Diesel, Inc. (EMD) and General Electric (GE). EMD makes two-stroke diesel locomotive motors, while GE makes four-stroke diesel locomotive motors. Locomotives manufactured currently may start at about 3000 horsepower, but the locomotives in service today still include a great many that are of lesser horsepower. The present disclosure relates to the retrofitting of two-stroke EMD locomotives, and in particular EMD locomotives of nominal 2000 horsepower or less, and higher horsepower EMD locomotives that are being downgraded to nominal 2000 horsepower or less. However, it will be understood that the structures and methods of the disclosure may be adapted to other motor or engine systems, including marine motors or larger locomotives, or four-stroke motor systems.

The United States Environmental Protection Agency (EPA) regulates locomotive emissions, and such regulations have provisions relating to the rebuilding of locomotives. In general, "rebuilding" typically involves replacing the motor pistons and liners. Unlike an automobile motor, a locomotive diesel motor has removable pistons and liners which are pulled out and replaced with new ones when the locomotive is overhauled.

Locomotives are typically overhauled every five to seven years, so within a time frame of that length most of the locomotives in the US are going to have to become EPA compliant. It is a lot easier to do that with a four-stroke than a two-stroke motor, but since most of the lower horsepower locomotives in existence utilize two-stroke engines built by EMD, the present disclosure is primarily directed to application with 2000 horsepower or less two-stroke EMD locomotives.

Two prior techniques are currently utilized for bringing rebuilt locomotives into compliance with the EPA regulations. One approach has been to remove the diesel motor, both generators and the compressor and replace them with two or three 750 horsepower gensets, which are basically standby power plants, such as hospitals use, which are provided with AC electrical generators. The electricity is converted to DC for powering the traction motors, and remains AC for providing power to the appliances, which may further include a new AC-powered compressor. A new electrical cabinet may be required as well, and the selling price on these units has a cost in the $1.4 million to $1.7 million range, depending on whether it is a two or three genset locomotive.

Another approach involves the installation of a single 2250 horsepower Detroit Diesel motor with a new AC generator, a new electric compressor and a new electrical cabinet. The cost is about the same as the previously described three genset unit, but there are fewer moving parts in the rebuilt unit.

What is desired is a less expensive alternative for retrofitting a locomotive. The present disclosure accomplishes this by enabling a locomotive engine to be retrofit without replacing the generator and some of the electrical components, thus achieving considerable savings. This has not been accomplished in the past due to the incompatibility of EPA compliant diesel engines with the generator and related electrical components of the locomotive to be rebuilt.

SUMMARY

The disclosure relates to a rebuilt engine powered apparatus which, prior to being rebuilt, was equipped with a generator and a prior engine.

In one aspect, the apparatus includes a generator compatible with the prior engine, the generator including a rotor; a replacement engine which replaces the prior engine and is not compatible with the generator; and a bearing support system located between the generator and the replacement engine.

The bearing support system includes an adaptor shaft mounted to the rotor, an adaptor frame mounted to the generator, a bearing assembly mounted to the adaptor frame opposite the generator and configured to receive the adaptor shaft, and a coupling hub mounted to the adaptor shaft adjacent the bearing assembly opposite the generator. The bearing support system supports the rotor of the generator and connects in a working manner the generator to the replacement engine.

In another aspect, the disclosure relates to a rebuilt locomotive which, prior to being rebuilt, was equipped with a generator and a two-stroke engine.

The rebuilt locomotive includes a generator compatible with the two-stroke engine, the generator including a rotor; a four-stroke replacement engine which replaces the prior two-stroke engine and is not compatible with the generator; a gear reduction unit provided by a transmission including a clutch configured to reduce the output of the four stroke replacement engine to the output of the replaced two-stroke engine; a bearing support system located between the generator and the replacement engine; and a misalignment coupling positioned to join and couple rotational output of the gear reduction unit to the bearing support system.

The bearing support system includes an adaptor shaft mounted to the rotor, an adaptor frame mounted to the generator, a bearing assembly mounted to the adaptor frame opposite the generator and configured to receive the adaptor shaft, and a coupling hub mounted to the adaptor shaft adjacent the bearing assembly opposite the generator. The bearing support system supports the rotor of the generator and connects in a working manner the generator to the four-stroke replacement engine.

In another aspect, the disclosure relates to for rebuilding an engine powered apparatus which, prior to being rebuilt, was equipped with a generator and a prior engine.

In one embodiment, the method includes the steps of: providing with the apparatus a generator comprising a generator compatible with the prior engine, the generator including a rotor; removing the prior engine and installing a replacement engine which replaces the prior engine and is not compatible with the generator; and providing a bearing support system and installing the bearing support system to the apparatus so that the bearing support system is located between the generator and the replacement engine.

The bearing support system includes an adaptor shaft mounted to the rotor, an adaptor frame mounted to the generator, a bearing assembly mounted to the adaptor frame opposite the generator and configured to receive the adaptor shaft, and a coupling hub mounted to the adaptor shaft adjacent the bearing assembly opposite the generator. The bearing support system supports the rotor of the generator and connects in a working manner the generator to the replacement engine.

In a further aspect, the disclosure relates to a method for rebuilding a locomotive which, prior to being rebuilt, was equipped with a generator and a two-stroke engine.

In one embodiment, the method includes the steps of: providing with the locomotive a generator comprising a generator compatible with the two-stroke engine, the generator including a rotor; removing the two-stroke engine and installing a replacement engine comprising a four-stroke engine which replaces the prior two-stroke engine and is not compatible with the generator; providing and installing onto the locomotive a gear reduction unit comprising a transmission including a clutch configured to reduce the output of the four stroke replacement engine to the output of the replaced two-stroke engine; providing a bearing support system and installing the bearing support system onto the locomotive so that the bearing support system is located between the generator and the replacement engine; and providing and installing onto the locomotive a misalignment coupling positioned to join and couple rotational output of the gear reduction unit to the bearing support system.

The bearing support system includes an adaptor shaft mounted to the rotor, an adaptor frame mounted to the generator, a bearing assembly mounted to the adaptor frame opposite the generator and configured to receive the adaptor shaft, and a coupling hub mounted to the adaptor shaft adjacent the bearing assembly opposite the generator. The bearing support system supports the rotor of the generator and connects in a working manner the generator to the four-stroke replacement engine.

The methods and apparatus of the disclosure enable cost effective rebuilding of locomotives that replaces the existing two-stroke diesel engine with a four-stroke diesel engine, while retaining the generator and its associated electronics. This avoids expensive replacement of the generator and associated electrical components.

The methods and apparatus of the disclosure also enable incompatibilities to be overcome to permit the output of virtually any engine to be effectively coupled to any generator or the like using the described components.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
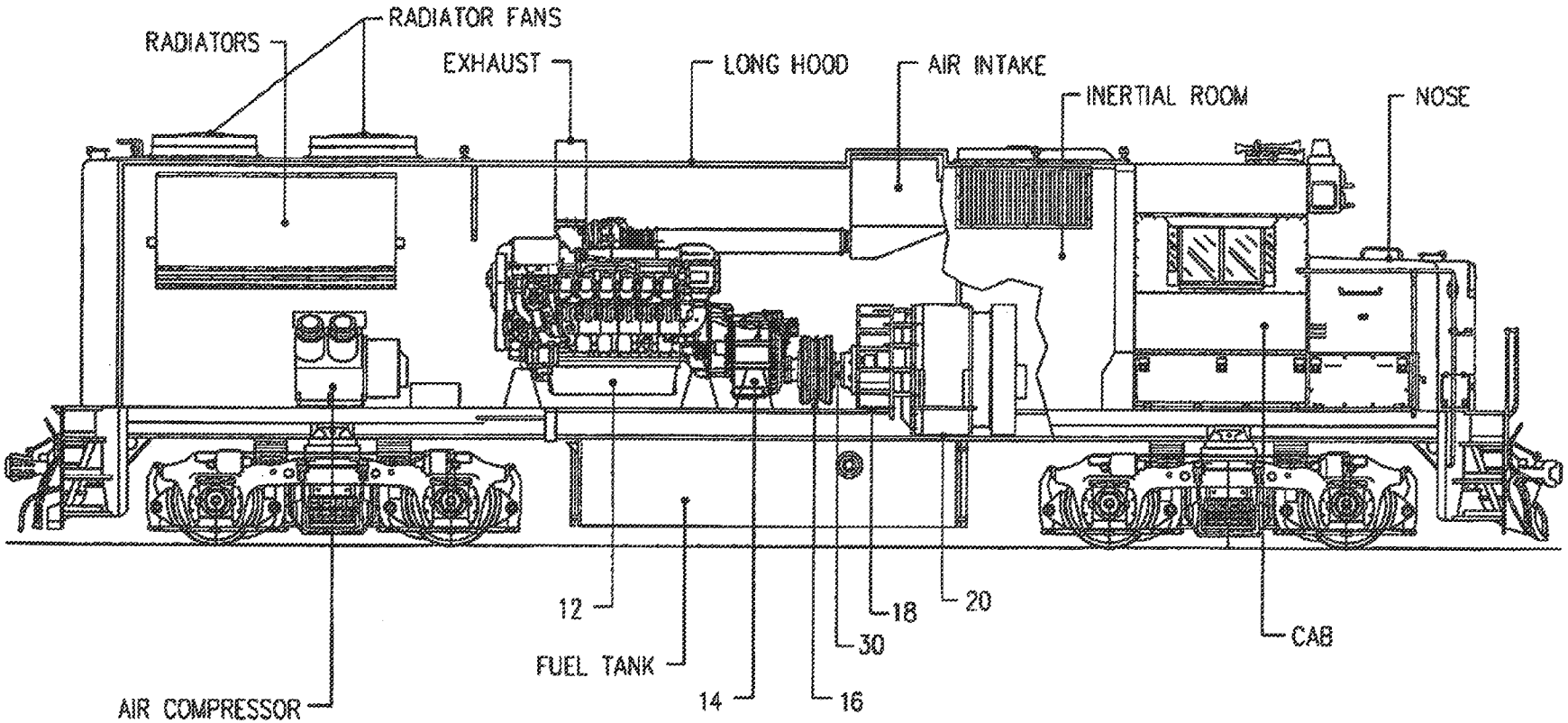
FIG. 1 shows a locomotive rebuilt according to the disclosure.

With reference to the drawings, the disclosure relates to methods and apparatus that enable cost effective rebuilding of locomotives that replaces the existing two-stroke diesel engine with a four-stroke diesel engine, while retaining the generator and its associated electronics. This avoids expensive replacement of the generator and associated electrical components. In this regard, while described in the context of a locomotive rebuild, it will be understood that the methods and apparatus of the disclosure also enable incompatibilities to be overcome to permit the output of virtually any engine to be effectively coupled to any generator or the like using the described components.

For the purposes of this disclosure, the terms "generator" as used herein means any a device that converts rotational mechanical energy to electrical energy. The output from a generator can be either direct current (DC), alternating current (AC), or both, depending on the design of the device.

In brief overview, rebuilding of a locomotive in accordance with the disclosure involves removing the original or existing EMD two-stroke diesel engine from the locomotive, while retaining the original or existing electrical generator and all its associated equipment. As will be appreciated, the existing two-stroke diesel engine has a maximum rotation rate of about 900 rpm, which matches the maximum operable rotational rate of the original generator that was designed to accompany the two-stroke diesel motor. However, because the replacement four-stroke diesel engine has a maximum rotational rate of about 1800 rpm, it is initially incompatible with the existing generator due to the higher rotational rate in excess of that of the maximum rotational rate of the generator.

To remedy the incompatibility of the new four-stroke engine and the existing generator, the new four-stroke diesel engine is installed and there is also installed a gear reduction unit specially configured so that the output of the new four-stroke diesel engine substantially corresponds to the output of the replaced two-stroke diesel engine, and hence the input range of the exiting generator. In addition, to enable the output of the gear reduction unit to be mechanically coupled to the input of the generator, it has been discovered that a bearing support system must be provided between the output of the gear reduction unit and the input of the generator. A misalignment coupling between the output of the gear reduction unit and the bearing support is also desirably utilized. In particular, the structure of the bearing support system has required extensive research and development to provide a suitable structure that will effectively function to provide a rebuilt locomotive.

Thus, utilization of the novel bearing support system has enabled a cost effective manner of rebuilding a locomotive that replaces the existing two-stroke diesel engine with a four-stroke diesel engine, while retaining the generator and its associated electronics.

With reference to FIG. 1, a retrofit locomotive 10 includes as newly installed components, a replacement diesel engine 12, a gear reduction unit 14, a misalignment coupling 16, and a bearing support system 18. The locomotive 10 retains is pre-existing generator 20. For context, also shown are some conventional components/parts of the locomotive 10, such as radiators, radiator fans, exhaust ports, hoods, air intake, inertial room, nose, cab, fuel tank, and air compressor.

As mentioned previously for the described example, the locomotive 10 originally had a two-stroke diesel engine, and the replacement diesel engine 12 is a four-stroke diesel engine. Accordingly, the gear reduction unit 14 is a transmission including a hydraulic clutch suitable to reduce the output of the new four-stroke diesel engine so that it substantially corresponds to the output of the replaced two-stroke diesel engine. Typically, this will be about a fifty percent reduction. The generator 20 which the retrofit is providing compatibility is typically an AR10 generator manufactured by EMD heretofore in direct drive connection with the EMD two-stroke diesel engine that is to be replaced.

The coupling 16 accommodates both axial and angular misalignments without sacrificing torsional rigidity. The coupling 16 joins and couples the output of the gear reduction unit 14 to the bearing support system 18, allowing the rotational energy to pass from the engine to the generator with maximum efficiency. The coupling 16 has a first end that connects to the output shaft of the gear reduction unit 14, a second end that connects to the bearing support system 18, and a flexible coupling structure therebetween that adjusts for misalignment between the first and second ends of the coupling. A suitable coupling for the coupling 16 is a Type BF butterfly misalignment coupling available from Geislinger GmbH of Austria.

Figure 2:
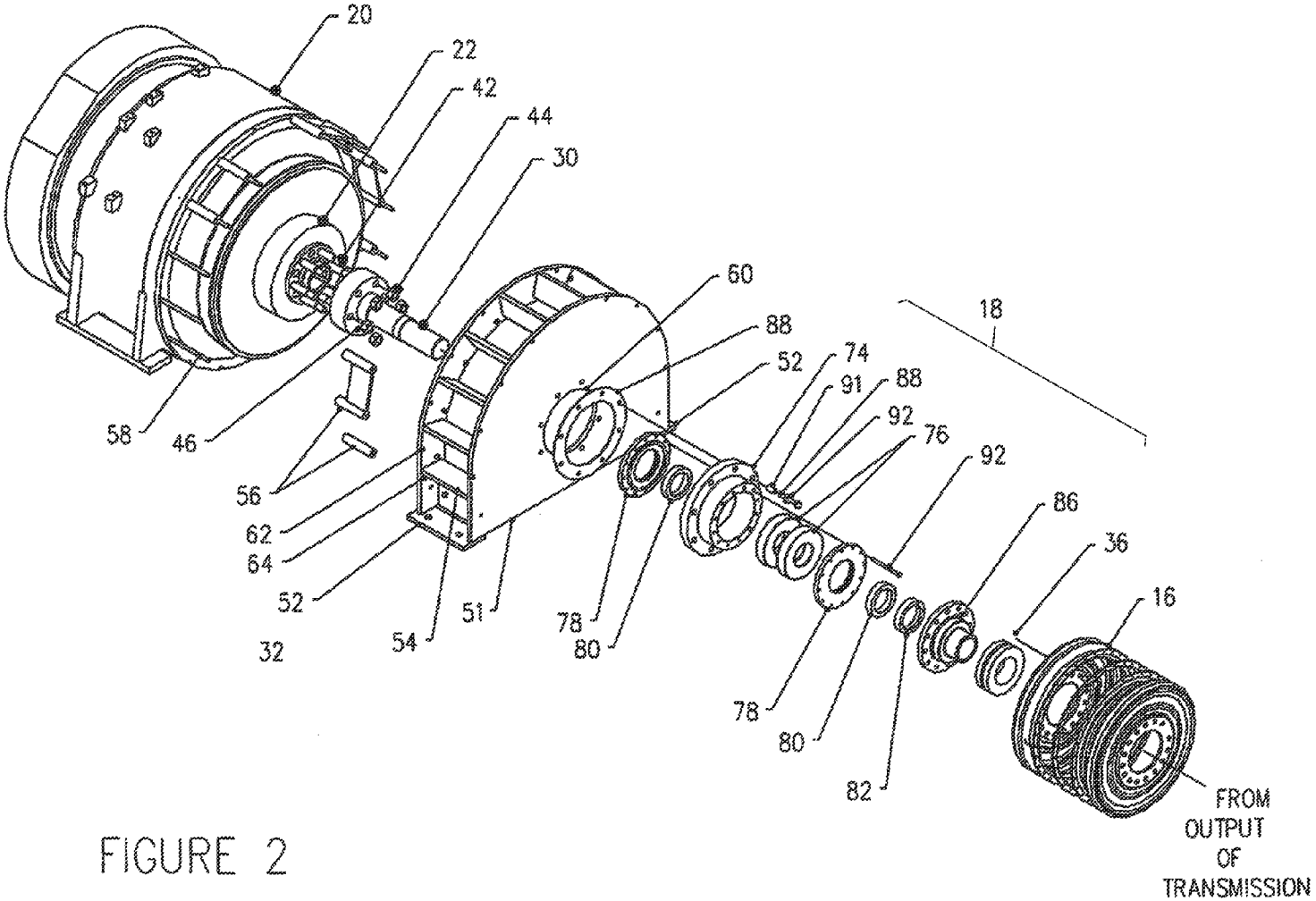
FIG. 2 is an exploded view of a bearing support component utilized in rebuilding the locomotive of FIG. 1, and which connects to a generator component and a flexible coupling component.
Figure 3:
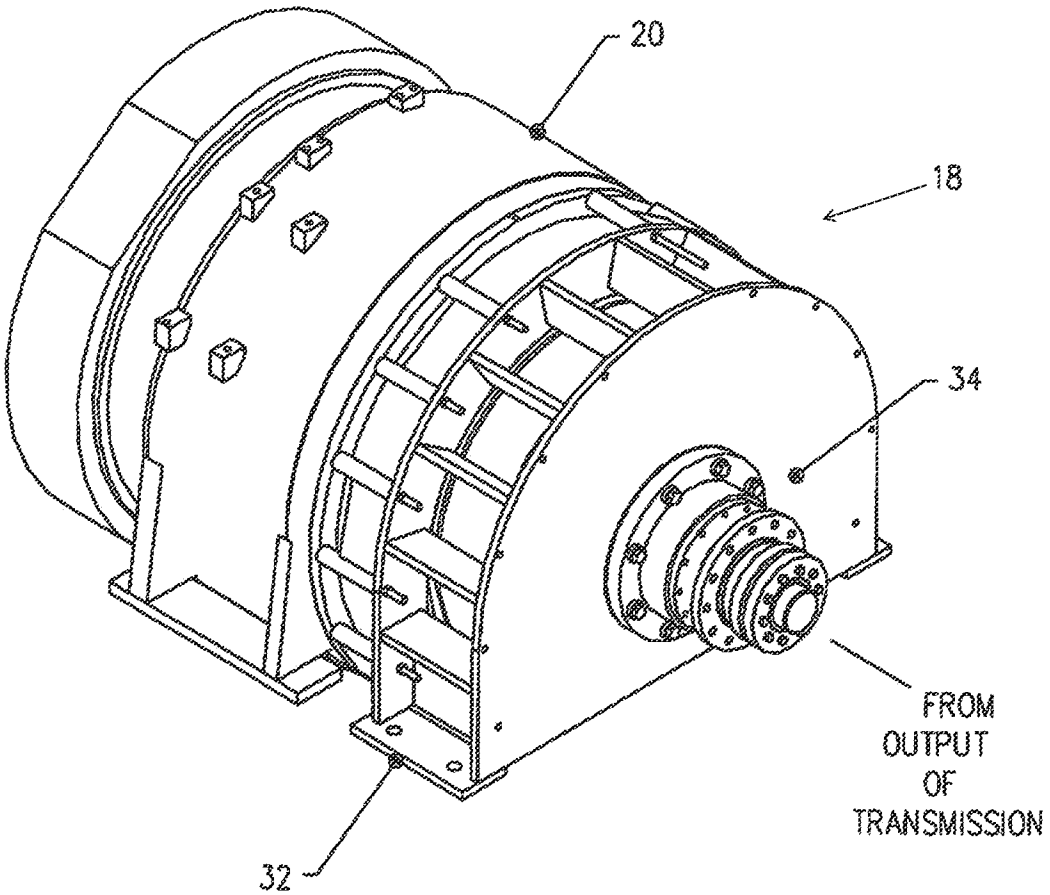
FIG. 3 shows the bearing support component attached to the generator component.

With reference to FIGS. 2 and 3, the bearing support system 18 is configured at one end to connect to the coupling 16 and at the opposite end to connect to a rotor 22 of the generator 20. In brief overview, the bearing support system 18 serves to aid in supporting the rotor 22 of the generator 20. In this regard, the generator 20 includes an existing rear main bearing that supports the rotor 22 when the generator 20 is connected to the original two-cycle diesel engine. It has been discovered, however, that the existing rear main bearing that is located within the generator 20 is unable to adequately support the rotor 22 for applications in which it is desired to connect the generator 20 to another source of rotary power, such as in the application of a four-stroke engine in place of the two-stroke engine for which the generator 20 is designed.

To enable preservation of the original generator 20 in a rebuilt locomotive, and the incumbent cost reductions achieved thereby, it has been discovered that the bearing support system 18 may be installed to permit adaptation of the generator 20 with a different rotary power source, such as a four-stroke diesel engine. Absent utilization of the bearing support system 18, it would not be possible to connect in a working manner the generator 20 to an alternate power source, such as a four-stroke diesel engine or other rotary power source different from the two-stroke diesel engine with which the generator 20 is designed to be used. In this regard, the bearing support system 18 supports an otherwise unsupported end of the rotor 22 of the generator 20. The bearing support system 18 also provides rotational, vibrational and/or translational dampening between the gear reduction unit 14 and the generator 20.

Figure 4:
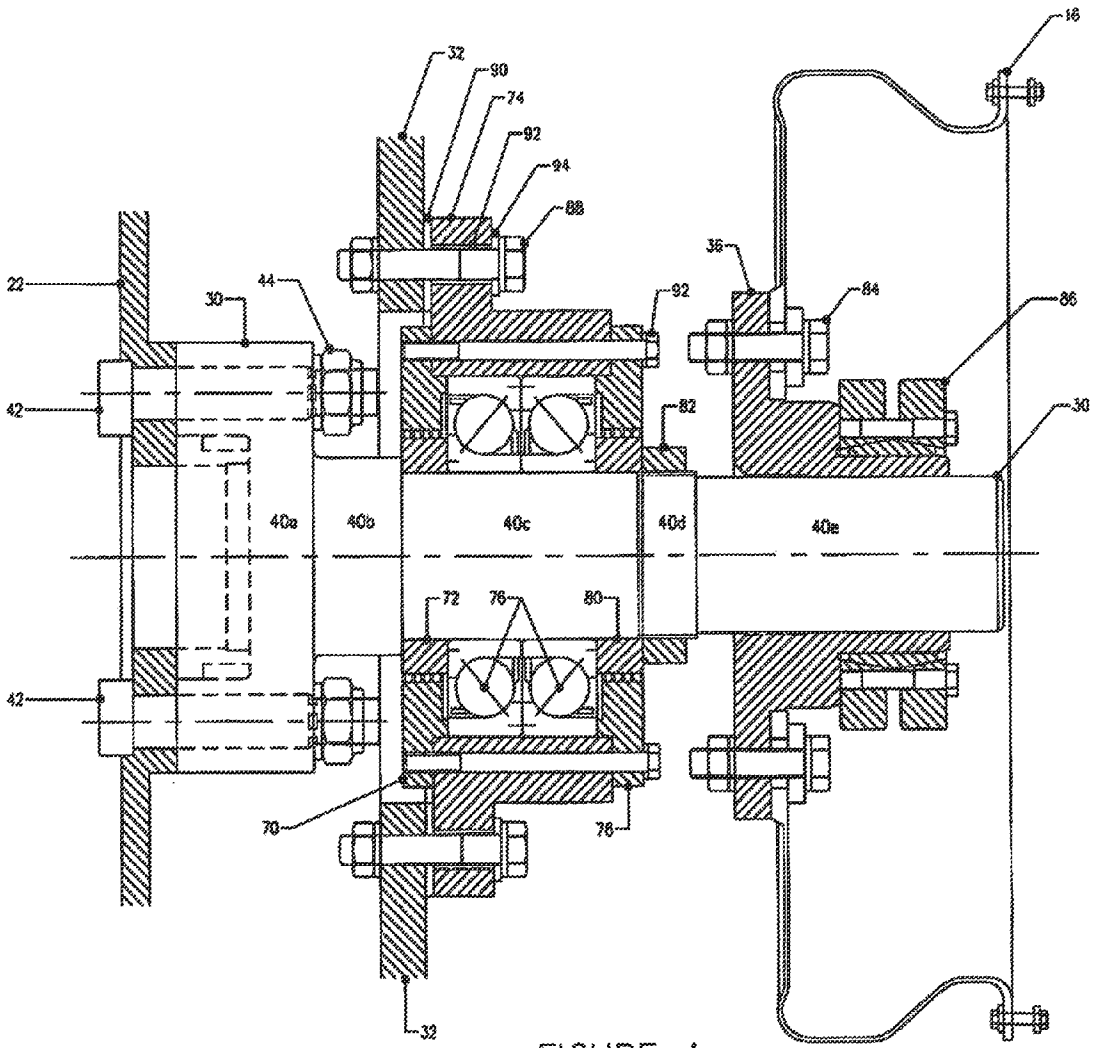
FIG. 4 is a cross-sectional side view showing the bearing support component attached to the generator component. And the flexible coupling component.

Returning to FIGS. 2 and 3, the bearing support system 18 includes, as major components, a rotor adapter shaft 30, an adaptor frame 32, a bearing assembly 34, and a coupling hub 36. The rotor adapter shaft 30 is of one-piece construction and includes shaft sections 40*a*, 40*b*, 40*c*, 40*d*, and 40*e* (FIG. 4). The shaft section 40*a* is configured to mount to the rotor 22 of the preexisting generator 20 using rotor bolts 42 and associated threaded nuts 44. The bolts 42 are configured to accommodate the rotor adapter shaft 30 and attach the rotor adapter shaft 30 to the rotor 22. The bolts 42 pass through aligned apertures 46 located on the shaft section 40*a*. As seen in FIG. 4, the shaft sections 40*a*-40*e* decrease in diameter in the direction away from the shaft section 40*a*. The shaft sections 40*a*-40*e* facilitate assembly of the components of the bearing assembly 34.

The adaptor frame 32 is configured to position and support the bearing support system 18 for the desired installation. As shown, the adaptor frame 32 spans between and mounts to both the generator 20 and the flexible coupling 16. The adaptor frame 32 includes as major components, a pair of spaced apart sidewalls 50 and 51, mounting feet 52, spacers 54, standoffs 56, and threaded mounting rods 58. Each of these may be of sturdy steel construction.

The sidewalls 50 and 51 are spaced apart by the spacers 54 a distance to enclose the rotor adapter shaft 30, and each include a central aperture, such as aperture 60 shown on the housing 51 for passage of the rotor adapter shaft 30. The mounting feet 52 are located at the bottom edges of the sidewalls 50 and 51 and include mounting apertures for bolting to the locomotive body. The spacers 54 are welded to the sidewalls 50 and 51 to provide a unitary and rigid structure. The threaded rods 58 are added to the face of the generator 20 as by drilling threaded bores into the face plate of the generator 20 and threading one end of the rods 58 therein. The standoffs 56 slip onto the installed threaded rods 58, and the sidewall 50 placed in abutment with the standoffs, with the distal ends of the rods 58 extending through aligned apertures 62 on the periphery of the sidewall 50. Threaded nuts 64 are installed on the distal ends of the rods 58 to secure the sidewall 50 in place adjacent the generator 20.

The bearing assembly 34 includes an inboard cap 70, a spacer 72, a bearing housing 74, a pair of ball bearings 76, an outboard cap 78, a spacer 80, and a bearing locknut 82. The ball bearings 76 are angular contact ball bearings configured to carry both radial and thrust loads, and provided as a matched set.

As seen in FIG. 4, the cap 70, spacers 72 and 80, bearing housing 74, bearings 76, and cap 78 are located on the shaft section 40*c*. The bearing locknut 82 mounts on the shaft section 40*d*. The bearings 76 are arranged in opposing lay so that they can carry thrust loads in either direction along the axis. The bearings 76 are pre-loaded by the bearing locknut 82. In this regard, when the bearings 76 are assembled onto the shaft section 40*c*, the bearing locknut 82 is pulled up tight, forcing the bearings 72 against the adjacent components and one another, pressing the bearings 76 into a desired load carrying position. In addition, a pair of annular grooves are desirably cut into the shaft 30 under each of the bearings 76 with a small hole drilled radially to connect each groove to a centrally located, deep-drilled hole. The grooves provide a path for highly pressurized hydraulic fluid to be introduced to the bores of the bearings to facilitate their removal.

The coupling hub 36 is a ring with a plurality of apertures for connection by fasteners 84 to the flexible coupling 16. The coupling hub 36 mounts on the shaft section 42 and a hub clamp 86 is used to clamp the hub 36 to the shaft section 40*d*. The bearing housing 74 and the inboard cap 70 are attached to the sidewall 51 of the adaptor frame 32 at the aperture 60 using bolts 88 which pass through commonly aligned apertures, with a gasket 90 located between the inboard cap 70 and the sidewall 51. The outboard cap 78 is attached to the bearing housing 74 opposite the inboard cap 70 using bolts 92.

As will be appreciated, the bearing support system 18 enables a cost effective manner of rebuilding a locomotive that replaces the existing two-stroke diesel engine with a four-stroke diesel engine, while retaining the generator and its associated electronics. For example, a completed retrofit locomotive can be built with only the removal and replacement of the diesel motor, and with the addition of the gear reduction unit 14, the misalignment coupling 16, and the bearing support system 18. This avoids expensive replacement of the generator and associated electrical components.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. An engine powered rebuilt apparatus which, prior to being rebuilt, was equipped with a generator and a first engine, the rebuilt apparatus comprising:

a second engine installed in the apparatus which replaces a first engine removed from the apparatus;

a generator comprising a rotor, wherein the generator is compatible with the first engine that has been removed from the apparatus and the generator is not compatible with the second engine that has been installed in the apparatus to replace the removed first engine; and a bearing support system located between the generator and the second engine connecting the generator with the second engine in a working manner, the bearing support system including an adaptor shaft mounted to the rotor, an adaptor frame mounted to the generator, a bearing assembly mounted to the adaptor frame opposite the generator and configured to receive the adaptor shaft, and a coupling hub mounted to the adaptor shaft adjacent the bearing assembly opposite the generator;

wherein the bearing support system supports the rotor of the generator and connects in a working manner the generator to the second engine, and wherein in the absence of the bearing support system, the second engine is not compatible with the generator.

2. The apparatus of claim 1, wherein the first engine comprises a two-stroke engine and the second engine comprises a four-stroke engine.

3. The apparatus of claim 2, further comprising a gear reduction unit comprising a transmission including a clutch configured to reduce the output of the four stroke engine to the output of the two-stroke engine.

4. The apparatus of claim 3, further comprising a misalignment coupling positioned to join and couple rotational output of the gear reduction unit to the bearing support system.

5. A rebuilt locomotive which, prior to being rebuilt, was equipped with a generator and a two-stroke engine, the rebuilt locomotive comprising:

a replacement engine comprising a four-stroke engine installed in the locomotive to replace replaces a two-stroke engine that has been removed from the locomotive;

a generator comprising a rotor, wherein the generator is compatible with the two-stroke engine that has been removed from the locomotive and the generator is not compatible with the four-stroke engine that has been installed in the apparatus to replace the removed two stroke engine;

a gear reduction unit comprising a transmission including a clutch configured to reduce the output of the four stroke replacement engine to the output of the replaced two-stroke engine;

a bearing support system located between the generator and the replacement engine connecting the generator and the replacement engine in a working manner, the bearing support system including an adaptor shaft mounted to the rotor, an adaptor frame mounted to the generator, a bearing assembly mounted to the adaptor frame opposite the generator and configured to receive the adaptor shaft, and a coupling hub mounted to the adaptor shaft adjacent the bearing assembly opposite the generator; and a misalignment coupling positioned to join and couple rotational output of the gear reduction unit to the bearing support system;

wherein the bearing support system supports the rotor of the generator and connects in a working manner the generator to the four-stroke replacement engine, and wherein in the absence of the bearing support system, the four-stroke replacement engine is not compatible with the generator.

6. The locomotive of claim 5, wherein the misalignment coupling comprises a butterfly coupling.

7. A method for rebuilding an apparatus powered by an engine which, prior to being rebuilt, was equipped with a generator and a first engine, the method comprising the steps of:

removing a first engine from the apparatus and installing a second engine which replaces the first engine;

providing with the apparatus a generator comprising a rotor, wherein the generator is compatible with the first engine and the generator is not compatible with the second engine; and providing a bearing support system and installing the bearing support system to the apparatus so that the bearing support system is located between the generator and the second engine and connects the generator with the second engine in a working manner, the bearing support system including an adaptor shaft mounted to the rotor, an adaptor frame mounted to the generator, a bearing assembly mounted to the adaptor frame opposite the generator and configured to receive the adaptor shaft, and a coupling hub mounted to the adaptor shaft adjacent the bearing assembly opposite the generator;

wherein the bearing support system supports the rotor of the generator and connects in a working manner the generator to the second engine, and wherein in the absence of the bearing support system, the second engine is not compatible with the generator.

8. A method for rebuilding a locomotive which, prior to being rebuilt, was equipped with a generator and a two-stroke engine, the method comprising the steps of:

removing a two-stroke engine from a locomotive and installing onto the locomotive a replacement engine comprising a four-stroke engine which replaces the prior two-stroke engine; providing with the locomotive a generator comprising a rotor, wherein the generator is compatible with the two-stroke engine;

providing with the locomotive a generator comprising a rotor, wherein the generator is compatible with the two-stroke engine and the generator is not compatible with the four-stroke engine;

providing and installing onto the locomotive a gear reduction unit comprising a transmission including a clutch configured to reduce the output of the four stroke engine to the output of the two-stroke engine;

providing a bearing support system and installing the bearing support system onto the locomotive so that the bearing support system is located between the generator and the four-stroke engine and connects the generator with the four stroke engine in a working manner, the bearing support system including an adaptor shaft mounted to the rotor, an adaptor frame mounted to the generator, a bearing assembly mounted to the adaptor frame opposite the generator and configured to receive the adaptor shaft, and a coupling hub mounted to the adaptor shaft adjacent the bearing assembly opposite the generator; and providing and installing onto the locomotive a misalignment coupling positioned to join and couple rotational output of the gear reduction unit to the bearing support system;

wherein the bearing support system supports the rotor of the generator and connects in a working manner the generator to the four-stroke engine, and wherein in the absence of the bearing support system, the four-stroke replacement engine is not compatible with the generator.

9. The method of claim 8, wherein the generator is a generator that was installed on the locomotive prior to the rebuilding of the locomotive.

* * * * *